US008844325B2

(12) United States Patent
Leibman et al.

(10) Patent No.: US 8,844,325 B2
(45) Date of Patent: Sep. 30, 2014

(54) LIQUID ADDITIVE DISPENSING APPARATUS FOR A WASHING MACHINE

(75) Inventors: Alexander Leibman, Louisville, KY (US); Alaknanda Acharya, Louisville, KY (US); Jerrod Aaron Kappler, Louisville, KY (US); Austin Vinoth Sargunum, Andhra Pradesh (IN)

(73) Assignee: General Electric Company, Schenectady, NY (US)

( * ) Notice: Subject to any disclaimer, the term of this patent is extended or adjusted under 35 U.S.C. 154(b) by 856 days.

(21) Appl. No.: 12/940,064

(22) Filed: Nov. 5, 2010

(65) Prior Publication Data

US 2012/0111067 A1 May 10, 2012

(51) Int. Cl.

| | |
|---|---|
| ***D06F 29/00*** | (2006.01) |
| ***D06F 33/00*** | (2006.01) |
| ***D06F 35/00*** | (2006.01) |
| ***D06F 39/02*** | (2006.01) |

(52) U.S. Cl.
CPC ..... *D06F 39/022* (2013.01)
USPC ..... 68/12.18

(58) Field of Classification Search
CPC ..... D06F 39/022
See application file for complete search history.

(56) References Cited

U.S. PATENT DOCUMENTS

| | | | | |
|---|---|---|---|---|
| 3,223,285 | A | | 12/1965 | Anderson et al. |
| 5,262,132 | A | * | 11/1993 | Bricker et al. ..... 422/263 |
| 5,413,259 | A | | 5/1995 | Cerruti et al. |
| 5,694,794 | A | | 12/1997 | Jerg et al. |
| 5,829,085 | A | | 11/1998 | Jerg et al. |
| 6,161,401 | A | | 12/2000 | Wunderlich et al. |
| 6,216,498 | B1 | | 4/2001 | Wright et al. |
| 6,282,927 | B1 | | 9/2001 | Wunderlich et al. |
| 6,327,729 | B1 | | 12/2001 | Wunderlich et al. |
| 6,668,389 | B1 | | 12/2003 | Cheng et al. |
| 7,275,552 | B2 | | 10/2007 | Deweerd et al. |
| 7,284,561 | B2 | | 10/2007 | Byrne et al. |
| 2008/0229790 | A1 | | 9/2008 | Kim et al. |

FOREIGN PATENT DOCUMENTS

| | | |
|---|---|---|
| EP | 0611843 B1 | 5/1998 |

* cited by examiner

*Primary Examiner* — Jason Ko

(74) *Attorney, Agent, or Firm* — Global Patent Operation; Douglas D. Zhang

(57) ABSTRACT

A liquid additive dispensing apparatus for dispensing a liquid additive into a washing machine having a tub accommodating a fluid and a basket rotatably disposed in the tub. A storage container is provided for storing the liquid additive. A tube is used to implement a fluid communication between the storage container and the tub. The tube has an inlet coupled to the storage container and an outlet coupled to the tub. The apparatus further has a venturi member arranged in the tub and in fluid communication with the outlet of the tube. The venturi member creates a venturi effect at the outlet of the tube when the wash basket rotates in the tub to send water or air into the venturi member, so that a reduced pressure is created at the outlet to suck the liquid additive from the storage container to the tub.

20 Claims, 10 Drawing Sheets

LIQUID ADDITIVE DISPENSING APPARATUS FOR A WASHING MACHINE

BACKGROUND OF THE INVENTION

The current disclosure relates generally to washing machines and, more specifically, to a liquid additive dispensing apparatus for a washing machine.

Generally, washing machines include a cabinet, which receives a stationary tub for containing wash and rinse water. A wash basket is rotatably mounted within the tub, and an agitating element is rotatably positioned within the wash basket. A drive assembly and a brake assembly are positioned with respect to the wash tub and configured to rotate and control the agitation of the wash basket to cleanse the articles loaded into the wash basket. Upon completion of a wash cycle, a pump assembly is configured to drain the soiled water to a draining system.

Recently, washing machines using liquid detergent in place of powder detergent or along with powder detergent have gained popularity. Traditionally, a washing machine using liquid detergent uses water to deliver the liquid detergent into the tub of the washing machine, which increases water consumption and thus raises environmental concerns. Alternatively, the washing machine relies on siphoning effect or gravity of the liquid detergent to dispense the liquid detergent into the tub. However, in such a case, residual liquid detergent may remain in the delivering pipelines. After certain time, the residual liquid detergent may solidify due to contact with the air. Solidification of liquid detergent may cause clogging of the pipelines and thus lead to malfunction of the washing machine. In addition, if the solidified liquid detergent is deposited in the tub, it may damage the components of the washing machine. Furthermore, for a washing machine relying on the gravity of the liquid detergent to deliver the detergent, a reservoir for containing the liquid detergent must be disposed in an altitudinal position higher than that of the tub, which may limit the design of the washing machine.

Therefore, it is desirable to provide a liquid detergent dispensing apparatus, which is environmental friendly by minimizing or eliminating water to deliver the liquid detergent, effectively prevent occurrence of clogging and solidification of the liquid detergent in delivering pipelines and offer leeway for designing the washing machine.

BRIEF DESCRIPTION OF THE INVENTION

As described herein, the exemplary embodiments of the current invention overcome one or more of the above or other disadvantages known in the art.

One exemplary aspect of the present invention relates to a liquid additive dispensing apparatus for a washing machine including a tub for accommodating a fluid and a wash basket rotatably disposed within the tub. Rotation of the wash basket rotates the fluid in the tub. The apparatus includes at least one storage container for storing a liquid additive and a tube for providing a fluid communication between the storage container and the tub. The tube has an inlet coupled to the storage container and an outlet coupled to the tub. The apparatus further includes a venturi member disposed within the tub and in fluid communication with the outlet of the tube. The venturi member is configured to create a venturi effect at the outlet of the tube upon rotation of the fluid so that a reduced pressure is created at the outlet to suck the liquid additive from the storage container to the tub.

Another exemplary aspect of the present invention relates to a washing machine. The washing machine includes a tub for accommodating a fluid and a wash basket rotatably disposed within the tub. Rotation of the wash basket rotates the fluid in the tub. The tub and the wash basket are apart to define a space therebetween. The washing machine further includes a liquid additive dispensing apparatus configured to dispense a liquid additive into the space. The liquid additive dispensing apparatus includes at least one storage container for storing a liquid additive and a tube for providing a fluid communication between the storage container and the tub. The tube has an inlet coupled to the storage container and an outlet coupled to the tub. The liquid additive dispensing apparatus further includes a venturi member disposed within the space and in fluid communication with the outlet of the tube. The venturi member is configured to create a venturi effect at the outlet of the tube upon rotation of the fluid so that a reduced pressure is created at the outlet to suck the liquid additive from the at least one storage container to the tub.

These and other aspects and advantages of the current invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

Figure 1:
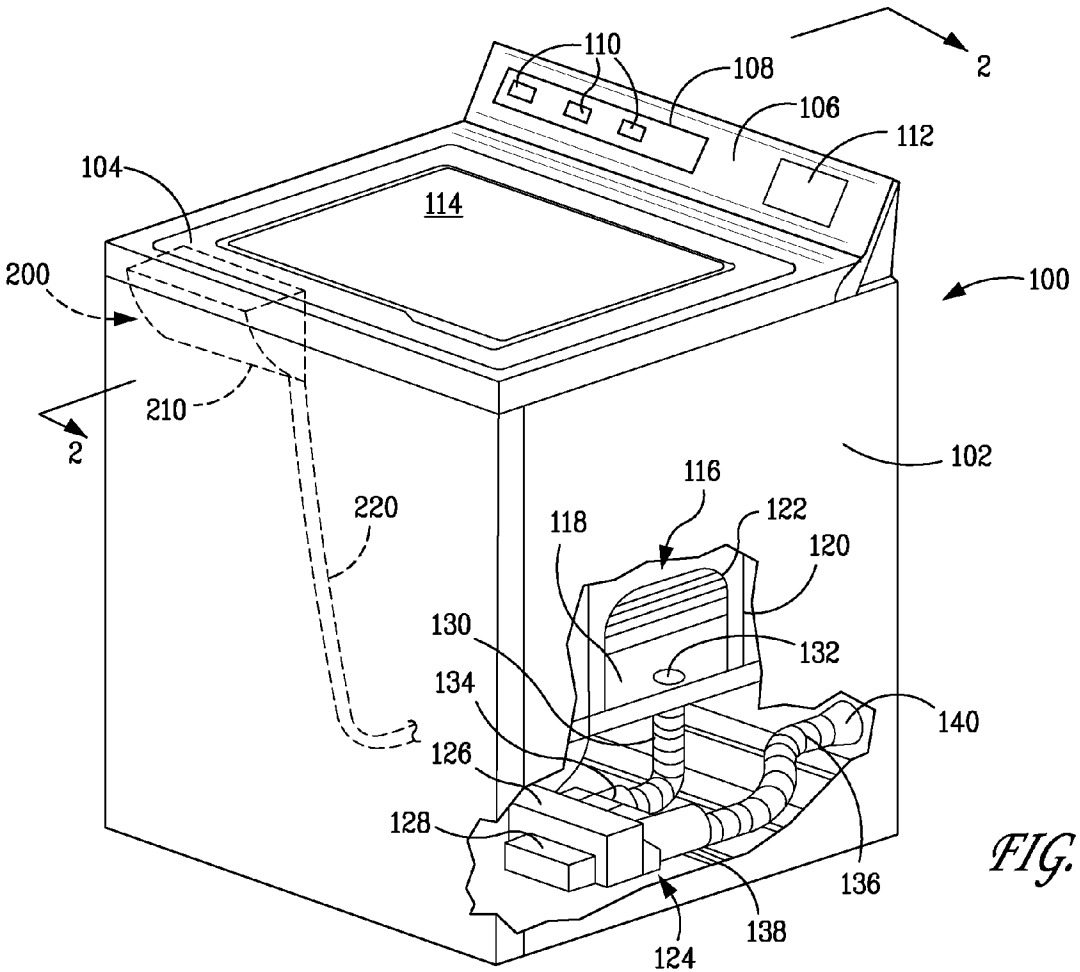
FIG. 1 is a perspective view of a washing machine in accordance with an exemplary embodiment of the present invention.

FIG. 1 is a schematic perspective view of an exemplary washing machine 100, with a part of the cabinet of the washing machine removed, according to an exemplary embodiment of the present invention.

As shown in FIG. 1, the washing machine 100 is a vertical axis washing machine. However, a person of ordinary skill in the art understands, under the guidance of the teachings provided herein, that the concept of the present invention is suitable for use with other types of washing machines including, without limitation, horizontal axis washing machines. Therefore, as the benefits of the herein described embodiments accrue generally to liquid addictive dispensing in a washing machine, the description herein is for exemplary purposes only and is not intended to limit practice of the invention to a particular type of a washing machine, such as the washing machine 100.

The washing machine 100 includes a cabinet 102, a cover 104 and a backsplash 106 extending from the cover 104. A control panel 108, including a plurality of input selectors 110, is coupled to the backsplash 106. The control panel 108 and the input selectors 110 collectively form a user interface input for operator selection of machine cycles and/or features. Optionally, the washing machine 100 may further include a display 112 indicating selected features, a countdown timer, and/or other items of interest to the machine users.

The washing machine 100 further includes a lid 114, which is pivotally mounted to the cover 104, for example, through a hinge (not shown). The lid 114 is capable of pivoting about the hinge between an open position (not shown) for allowing a user to access a wash tub 116 mounted within the cabinet 102 and a closed position (as shown in FIG. 1) to sealingly cover the wash tub 116 to prevent spillage. The wash tub 116 includes a bottom wall 118 and a sidewall 120. A wash basket 122 of the washing machine 100 is rotatably mounted within the wash tub 116.

As shown in FIG. 1, the washing machine 100 further includes a pump assembly 124 located beneath the tub 116 and the wash basket 122 to assist draining the wash tub 116. The pump assembly 124 includes a pump 126 and a motor 128. A pump inlet hose 130 extends from a wash tub outlet 132 in tub bottom wall 118 to a pump inlet 134, and a pump outlet hose 136 extends from a pump outlet 138 to a washing machine water outlet 140 and ultimately to a building plumbing system discharge line (not shown) in flow communication with the water outlet 140.

Figure 2:
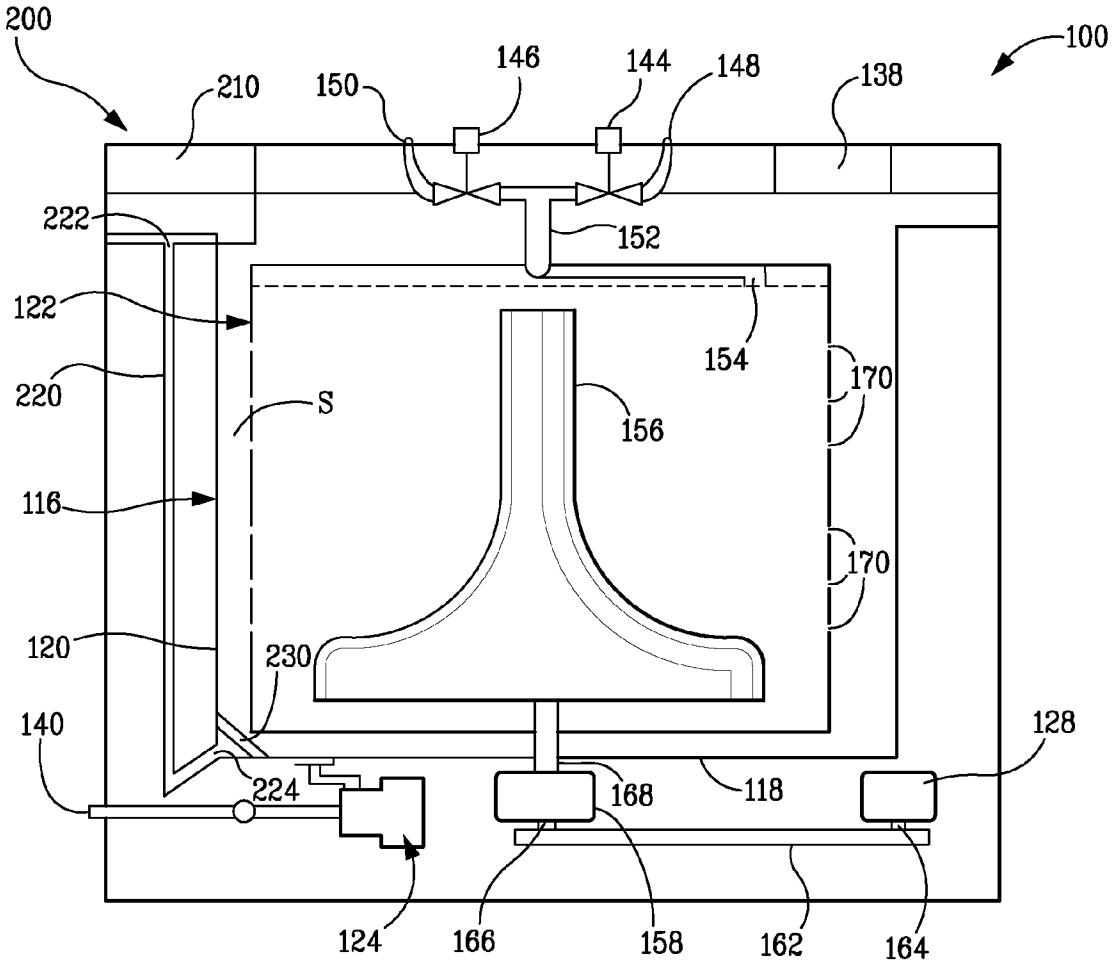
FIG. 2 is a schematic sectional view of the washing machine alone Lines 2-2 shown in FIG. 1.

FIG. 2 is a schematic sectional view of the washing machine 100, illustrating the liquid additive dispensing apparatus 200 for dispensing liquid additive into a space between the tub 116 and the wash basket 122.

As shown in FIG. 2, the wash basket 122 is movably disposed and rotatably mounted in the wash tub 116 through an axle 168. The wash basket 112 is spaced apart from the tub bottom wall 118 and the tub sidewall 120. Accordingly, a space S is provided between the wash basket 122 and the wash tub 116.

The wash basket 122 includes a plurality of perforations 170 disposed along the perimeter thereof, for facilitating fluid communication between a cavity defined by the wash basket 122 and the wash tub 116. A hot water valve 144 and a cold water valve 146 deliver water to the wash basket 122 and the wash tub 116 through a respective hot water hose 148 and a cold water hose 150. The valves 144, 146 and the hoses 148, 150 together form a water supply connection for the washing machine 100. When the washing machine is connected to a building plumbing system (not shown), the water supply connection provides a fresh water supply for use in washing machine 100. The valves 144, 146 and the hoses 148, 150 are connected to a wash basket inlet tube 152, and water is dispensed from the inlet tube 152 through a nozzle assembly 154 having a plurality of openings for directing water into the wash basket 122 at a given trajectory and/or velocity.

The washing machine 100 further includes an agitator 156, such as a vane agitator, impeller, auger, oscillatory basket mechanism or a combination thereof, disposed in the wash basket 122 and also mounted on the axle 168. The agitator 156 imparts an oscillatory motion to the articles at least partially suspended by the water within the wash basket 122. The wash basket 122 and the agitator 156 are driven by a motor 128 through a transmission and clutch system 158. A transmission belt 162 is coupled to a motor output shaft 164 and a transmission input shaft 166. Thus, as the motor output shaft 164 is rotated, the transmission input shaft 166 is also rotated. The transmission and clutch system 158 drives the axle 168 to rotate the wash basket 122 and the agitator 156 within the wash tub 116. For example, the transmission and clutch system 158 facilitates relative rotation of the wash basket 122 and the agitator 156 for selected portions of one or more wash cycles. For example, the wash basket 122 can rotate at 700 RPM within the wash tub 116.

As shown in FIG. 2, the washing machine 100 further includes a liquid additive dispensing apparatus 200, according to an exemplary aspect of the present invention. The liquid additive dispensing apparatus 200 dispenses and delivers an additive in liquid form into the wash tub 116 of the washing machine 100, for facilitating cleaning articles loaded within the rotatable wash basket 122 of the washing machine 100. The additive includes, but is not limited to, liquid detergent, bleach, softener and/or solid detergent, bleach and softener mixed with water.

The liquid additive dispensing apparatus 200 includes at least one storage container 210 for holding and storing liquid additive, a tube 220 for implementing a fluid communication between the storage container 210 and the wash tub 116, and a venturi member 230 disposed within the tub 116. The tube 220 includes an inlet 222 coupled to the storage container 210 and an outlet 224 coupled to the tub 116.

A venturi effect is a reduction of fluid pressure that results when a fluid flows through a constricted section of a fluid passageway. When the wash basket 122 rotates within the tub 116, a fluid in the tub 116, such as water, air or a mixture thereof, passes through the venturi member 230 to create a venturi effect at the outlet 224 of the tube 220, where the tube 220 intersects the tub 116. Accordingly, a reduced fluid pressure or even a vacuum is created at the outlet 224 to suck the liquid additive from the storage container 210 into the tub 116, for example, into the space S between the wash basket 122 and the tub 116.

For example, the liquid additive dispensing apparatus 200 is mounted within the cabinet 102. For example, the liquid additive dispensing apparatus 200 is electrically coupled to the control panel 108 so that a user can control the operation of the liquid additive dispensing apparatus 200 through the interface provided by the control panel 108.

Figure 3:
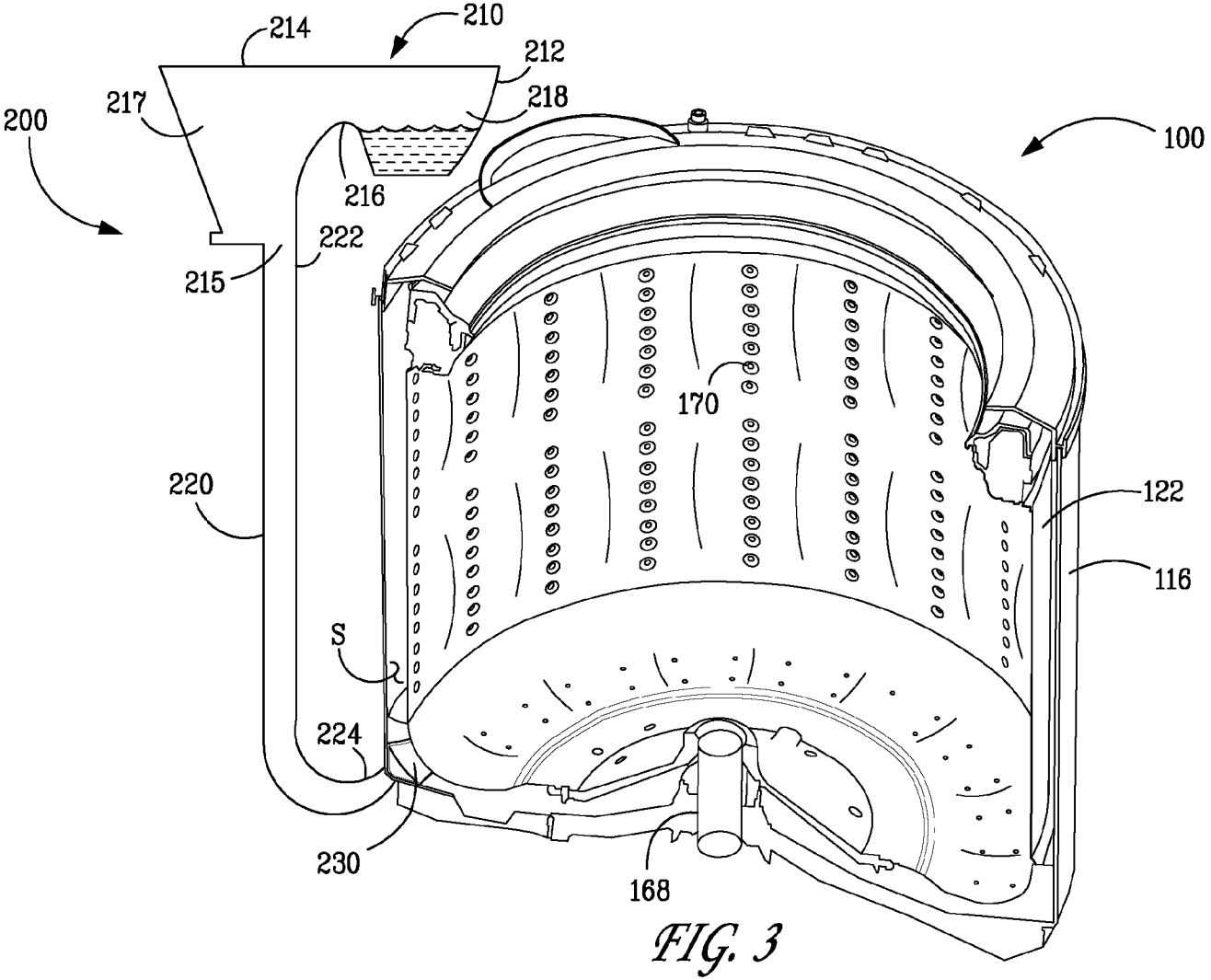
FIG. 3 is a partial perspective view of the washing machine and the liquid additive dispensing apparatus.

FIG. 3 is a partial perspective view of the washing machine 100 and the liquid additive dispensing apparatus 200, with the cabinet 102, part of the wash tub 116 and part of the wash basket 122 removed. The venturi member 230 is disposed at a lower corner of the wash tub 116, defined by the bottom wall 118 and sidewall 120, and in fluid communication with the liquid additive storage container 210 through the tube 220.

Figure 4:
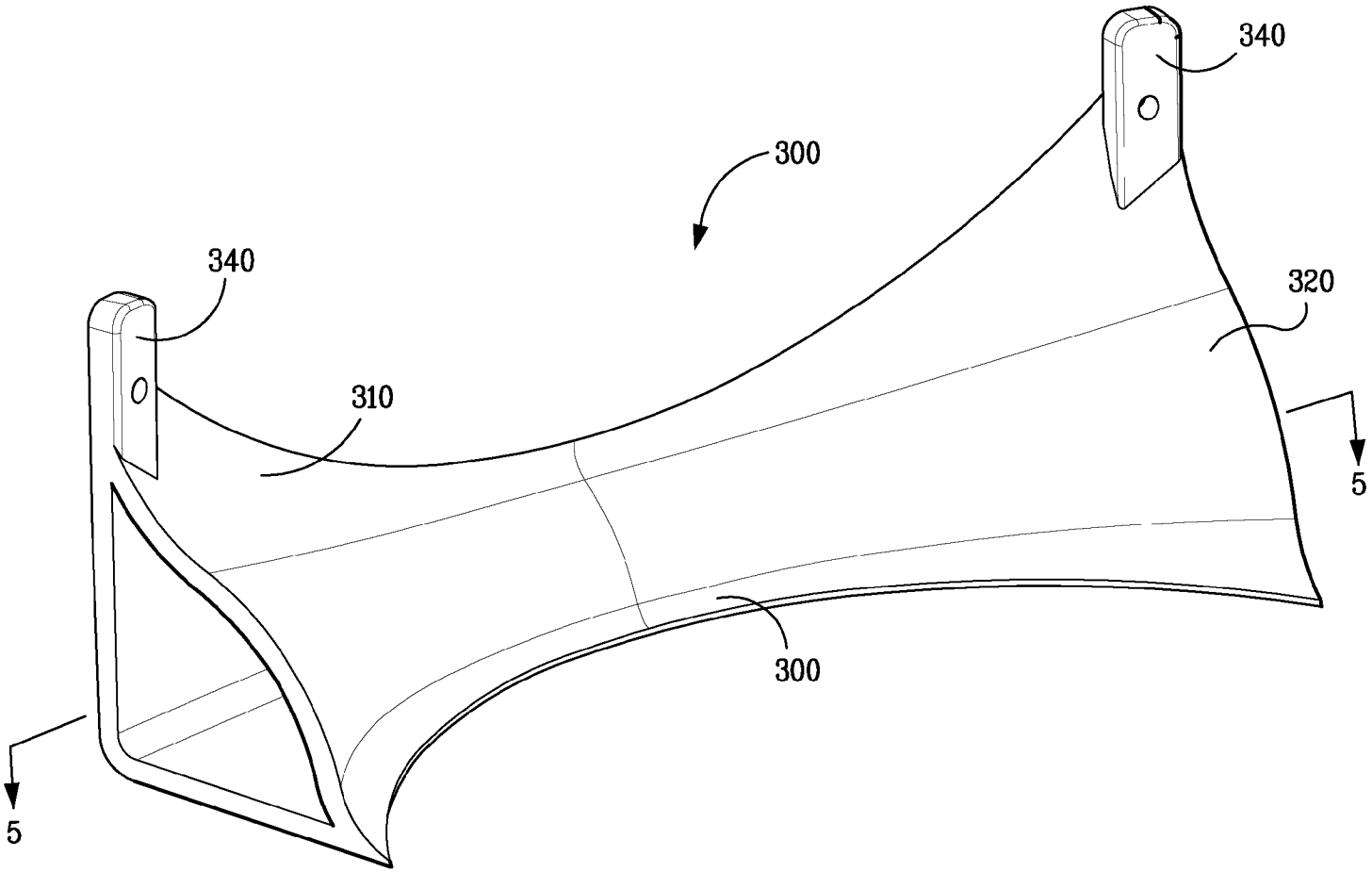
FIG. 4 is a perspective view illustrating an exemplary embodiment of the venturi member of the liquid additive dispensing apparatus.

One exemplary embodiment of the venturi member 230 is shown in FIG. 4. In this embodiment, the venturi member 230 is shown as a venturi tube 300. The venturi tube 300 includes a first portion 310, an opposite second portion 320, and a throat portion 330 connecting the first portion 310 and the second portion 320. The throat portion 330 is sufficiently smaller in cross section than the first portion 310 and the second portion 320, so that a venturi effect can be implemented by the venturi tube 300, when a fluid passes through the venturi tube 300. The outlet 224 of the tube 220 is in fluid communication with the throat portion 330 of the venturi tube 300, so that the liquid additive can flow from the storage container 210 into the throat portion 330.

In the shown embodiment, the first portion 310 is a substantially tapered portion having cross sections decreasing gradually toward the throat portion 330. Similarly, the second portion 320 is a substantially tapered portion having cross sections decreasing gradually toward the throat portion 330.

Although in the shown embodiment, both the first portion 310 and the second portion 320 are substantially tapered, a person of ordinary skill in the art understands that the first portion and the second portion may have consistent cross sections, which can be different from each other, as long as the narrowed throat portion is sufficiently smaller in cross section than both the first portion and the second portion to be able to create a venturi effect. Alternatively, one of the first and second portions can have a tapered cross section and the other can have a consistent cross section.

In addition, a person of ordinary skill in the art understands that the tapered portions can have any suitable geometrically regular cross sections (such as circular, square, triangle cross sections and so on), geometrically irregular cross sections, and any combination thereof.

The venturi tube 300 is dimensioned so that it can be placed within the space S between the wash tub 116 and the wash basket 122, without interfering the rotation of the wash basket 122 and any other operation of the washing machine 100. The venturi tube 300 is fixedly attached to the bottom wall 118 and/or sidewall 120 of the wash tub 116, through any known means. For example, the venturi tube 300 includes a pair of tabs 340 extending from the first portion 310 and the second portion 320, respectively, which can be fixed to the sidewall 120 of the wash tub 116 through nails or screws.

In the shown embodiment, when the wash basket 122 rotates around the axle 168 within the wash tub 116 at a predetermined speed, a flow of fluid, in this embodiment a water flow, is established through the venturi tube 300 having two opposite portions 310 and 320 and a constricted throat portion 330, which creates a venturi effect at the throat portion 330 of the venturi tube 300. The venturi effect results in a reduction of fluid pressure in the throat portion 330. Depending on the rotating speed of the wash basket 122, a significant reduction of pressure or even a vacuum can be created in the throat portion 330, which results in a suction effect drawing the liquid additive from the liquid additive storage container 210 to the outlet 224 of the tube 220.

The fluid flow through the venturi member can be a flow of air, a flow of water or a flow of mixed air and water, depending on the specific design of the venturi member, such as the position of the storage container, and the liquid suction power required for drawing the liquid additive from the storage container into the wash tub.

Rotating direction of the wash basket 122 determines which tapered portion of the venturi tube 300 is an intake taper or an exit taper. For example, if the wash basket 122 rotates clockwise, the fluid flow enters the first portion 310, subsequently passes through the throat portion 330, and eventually exits the second portion 320 at an increased speed. The liquid additive sucked into the throat portion 330, due to the reduction of fluid pressure in the throat portion 330, is mixed with the fluid flow and consequently delivered into wash tub 116 through the second portion 320.

Figure 5:
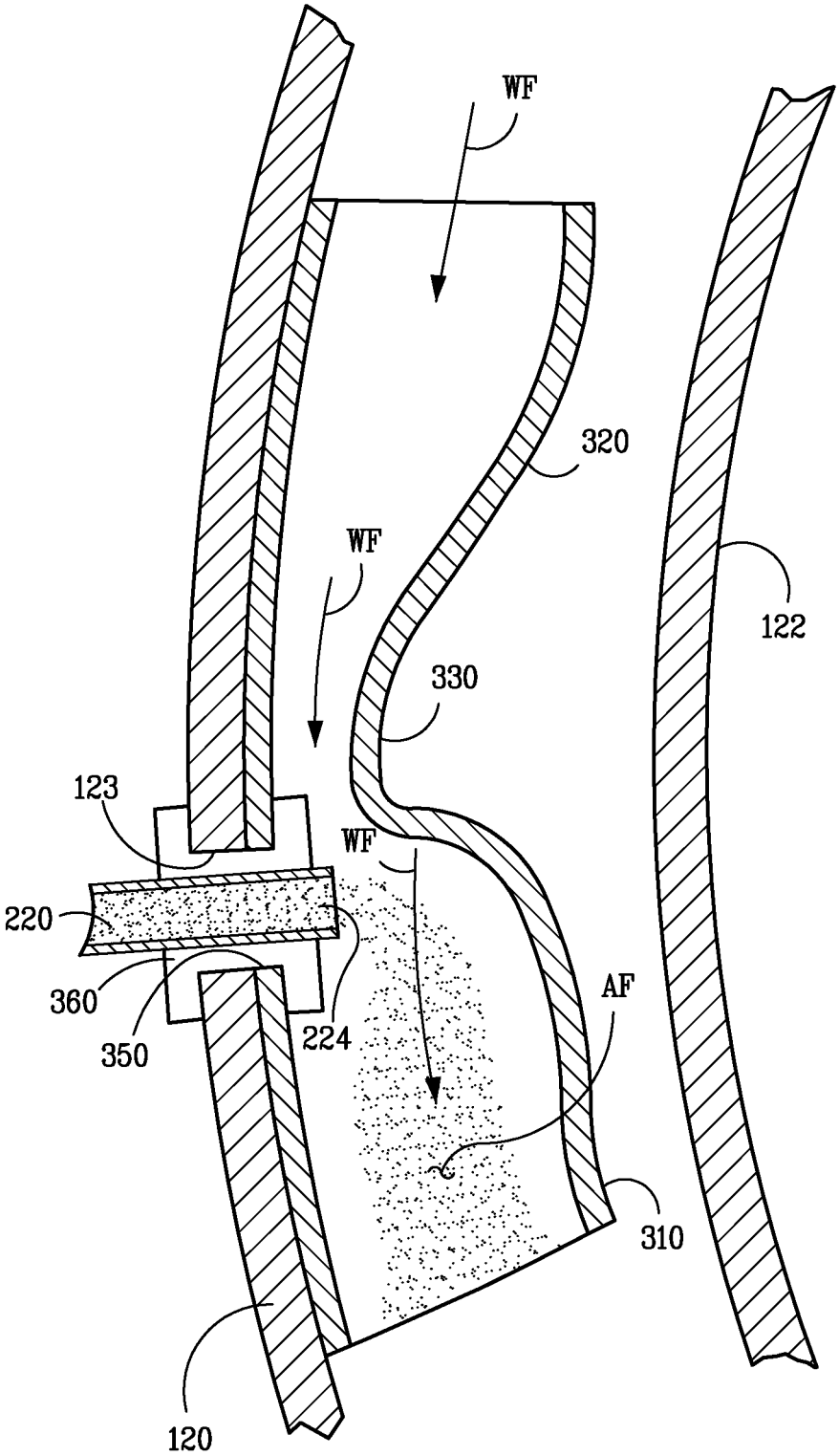
FIG. 5 is a schematic sectional view of the venturi member disposed in the washing machine, along Lines 5-5 shown in FIG. 4.

FIG. 5 is a schematic view of the venturi tube 300 along Lines 5-5 in FIG. 4, after the venturi tube 300 is mounted to the washing machine 100. In the shown embodiment, the wash basket 112 rotates counter clockwise to generate a water flow WF passing through sequentially the second portion 320, the throat portion 330 and the first portion 310 of the venturi tube 300, as shown by the arrows in FIG. 5.

The tube 220 is inserted into the venturi tube 300 through an opening 123 formed in the sidewall 120 of the wash tub 116 and a corresponding opening 350 formed in the venturi member 300, to allow the outlet 224 of the tube 220 be exposed to the throat portion 330 of the venturi member 300. A sealing member 360 is provided to ensure that no fluid leaking occurs between the tube 220 and the venturi tube 300/tub 116. In the shown embodiment, the outlet 224 of the tube 220 is exposed at a position adjacent to and downstream of the throat portion 330 along the direction of the water flow WF. Thus, when the water flow WF flows through the venturi tube 300 to create a venturi effect, the liquid additive is drawn from the storage container 210 to form a liquid additive flow AF, as shown by the dotted lines in FIG. 5.

Referring back to FIG. 3, the liquid additive storage container 210 includes a body 212 for containing the liquid additive and a cover 214 for sealingly closing the body 212. The body 212 has an opening 215 connected to the inlet 222 of the tube 220, to allow the liquid additive to flow from the body 212 into the tube 220. In the shown embodiment, the body 212 includes a raised ridge 216 dividing the body 212 into a first chamber 217 having the opening 215 and a second chamber 218 for holding a certain amount of liquid additive. The first chamber 217 and the second chamber 218 are in fluid communication with one another.

The surface of the liquid additive in the second chamber 218 is disposed below the top of the raised ridge 216, so that the liquid additive is normally contained in the second chamber 218 and sucked into the first chamber 217 once the reduced fluid pressure at the outlet 224 of the tube 220 adjacent to the throat portion 330 is below a predetermined value. The rotating speed of the wash basket 122 can be predetermined and/or adjusted to implement a sufficient reduction of fluid pressure under venturi effect, so that the liquid additive in the second chamber 218 can pass over the raised ridge 216 and enter the first chamber 217.

Figure 6:
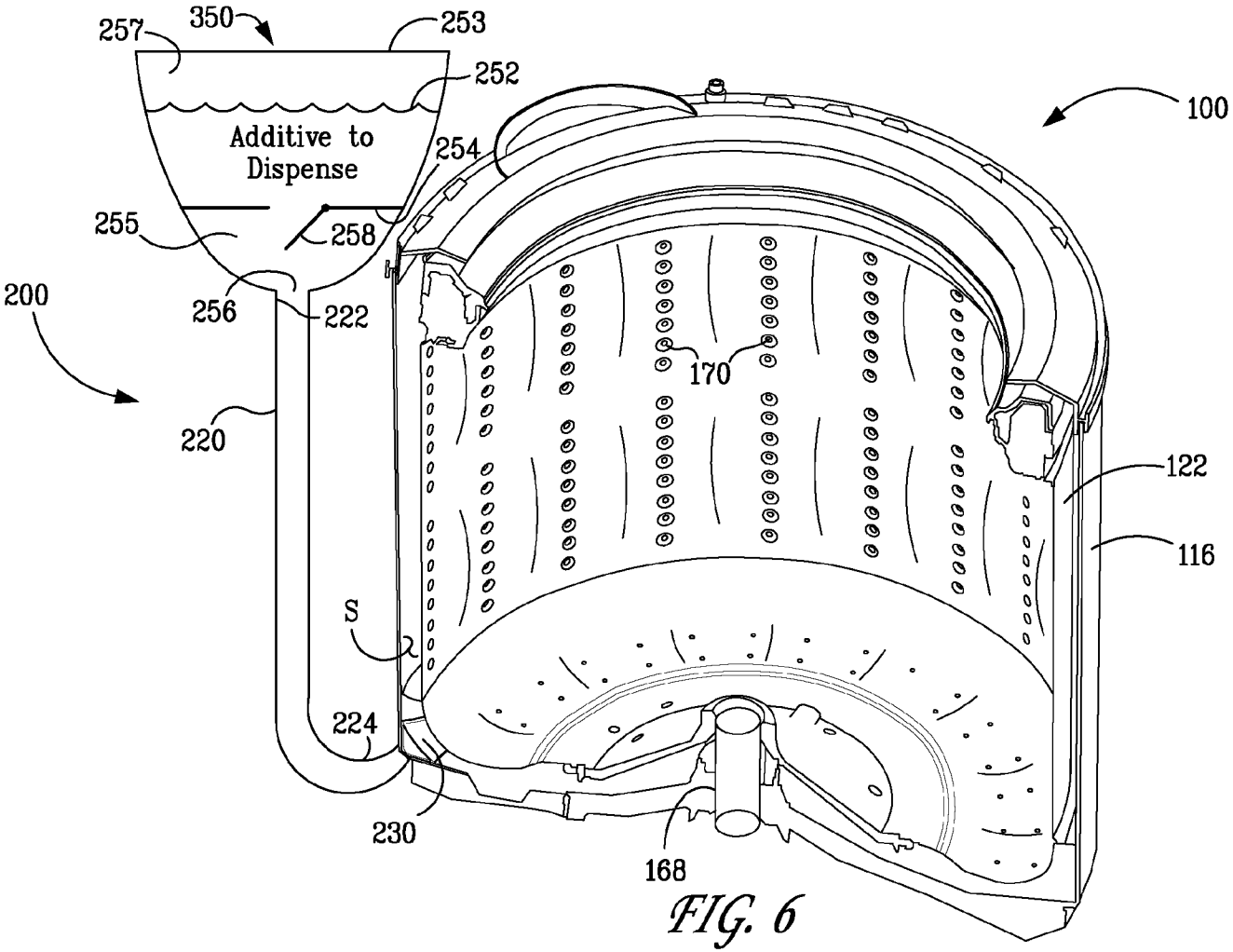
FIG. 6 is another partial perspective view of the washing machine and the liquid additive dispensing apparatus.

FIG. 6 illustrates another exemplary embodiment of the liquid additive storage container, identified by numeral 250. In this embodiment, the liquid additive storage container 250 includes a body 252 for containing the liquid additive and a cover 253 for sealingly closing the body 252. A diaphragm 254 is further provided within the body 252 for dividing the body 252 into a first chamber 255 having an opening 256 in fluid communication with the inlet 222 of the tube 220 and a second chamber 257 for holding the liquid additive between the diaphragm 254 and the cover 253. A normally closed valve 258 is provided in the diaphragm 254. Accordingly, the liquid additive in the second chamber 257 cannot flow into the first chamber 255 until the valve 258 opens when the reduced pressure at the outlet 224 adjacent to the throat portion 330 of the venturi tube 300 is below a predetermined value. For example, the valve 258 can be a spring-biased valve, which can be pulled open by the reduced fluid pressure when the suction force applied by the reduced fluid pressure overcomes the spring force of the valve. The reduction of pressure in the venturi tube 300 can be controlled by the rotating speed of the wash basket 122 within the wash tub 116.

Although in the shown embodiment, the diaphragm 254 is substantially horizontal to divide the body 252 into a lower chamber 255 and an upper chamber 257, a person of ordinary skill in the art understands that the diaphragm can be disposed substantially vertical or diagonally within the body and the divided chambers can be side by side. Furthermore, the shape of the body 212/252 can vary from what is shown in the figures, without departing from the spirit of this aspect of the present invention. In addition, due to the suction effect implemented by the venturi member 230, the gravity of the liquid additive is no longer relied on for delivering the liquid additive. Accordingly, the opening 215/256 of the storage container 210/250 can be disposed at any possible location of the container body, for example, at the top of the container body. Also, the storage container can be disposed altitudinally lower than the wash tub 116. These features offer convenience for designing the washing machine, especially when the space within the washing machine is limited.

Figure 7:
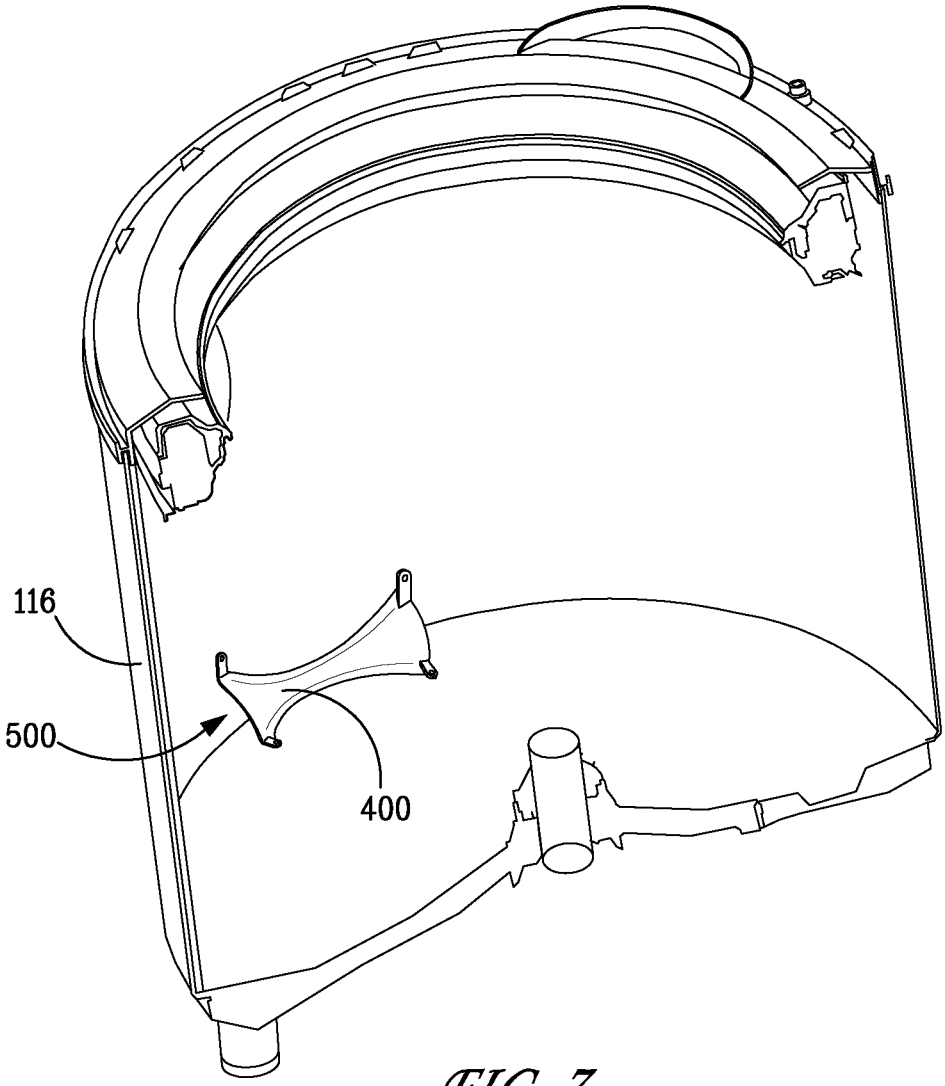
FIG. 7 is a partial perspective view of the wash tub, illustrating another exemplary embodiment of the venturi member of the liquid additive dispensing apparatus.
Figure 8:
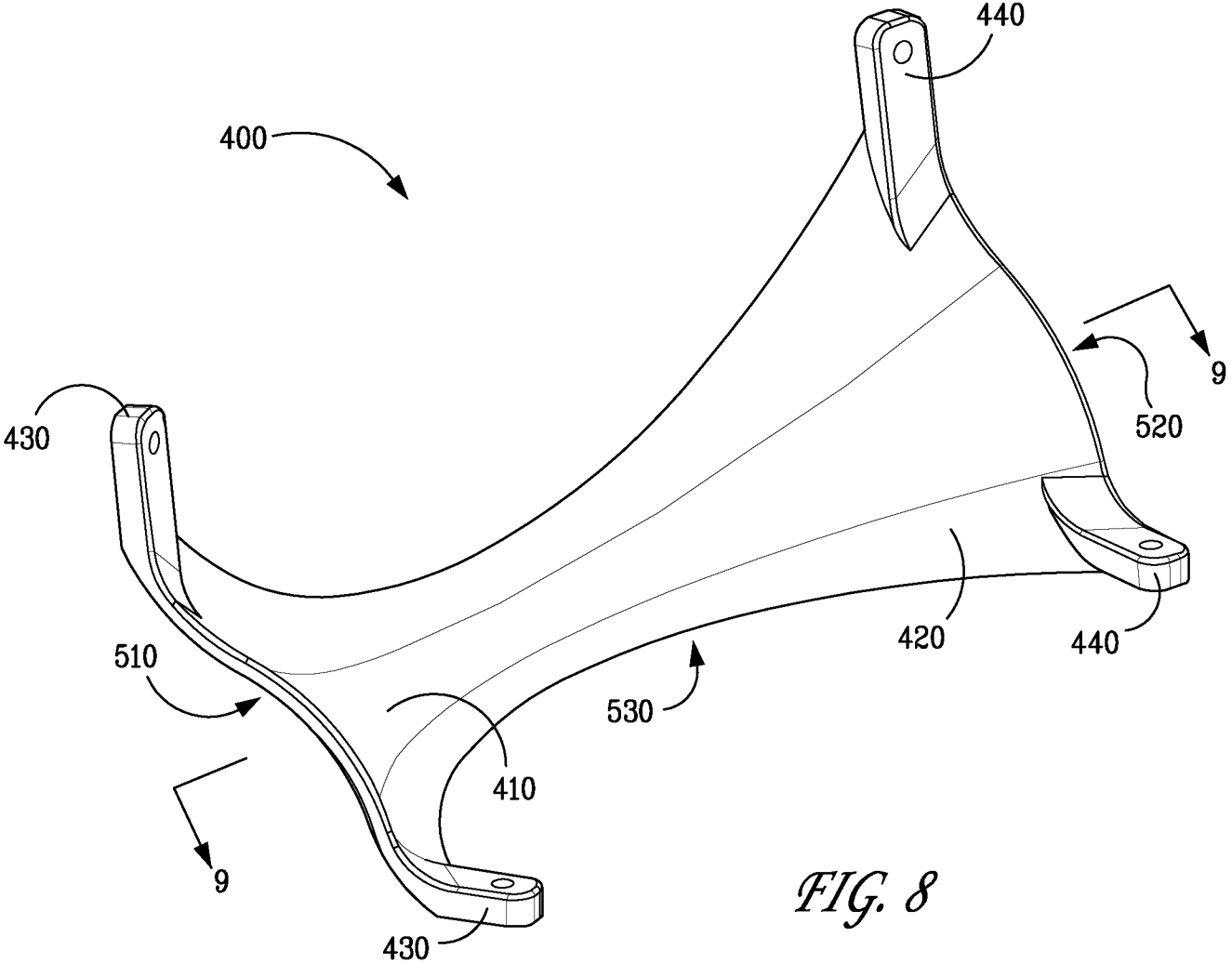
FIG. 8 is an enlarged perspective view of the venturi member shown in FIG. 7.

FIG. 7 illustrates another exemplary embodiment of the venturi member 230. In this exemplary embodiment, the venturi member 230 is shown as a venturi plate 400 mounted to the bottom wall 118 and the sidewall 120 of the wash tub 116. FIG. 8 is an enlarged view of the venturi plate 400.

In the shown embodiment, the venturi plate 400, the bottom wall 118 and the sidewall 120 collectively define a passageway 500, through which the fluid in the wash tub 116 flows with the rotation of the wash basket 122. One or more sealing member can be provided to ensure that no fluid leaking occurs at the interfaces of the venturi plate 400 and the sidewall 120/bottom wall 118 of the wash tub 116.

In order to implement a venturi effect, the venturi plate 400 is shaped and dimensioned so that, after it is mounted to the bottom wall 118 and the sidewall 120 of the wash tub 116, the resultant passageway 500 has a first portion 510, an opposite second portion 520 and a throat portion 530 connecting the first and second portions. The outlet 224 of the tube 220 is in fluid communication with the throat portion 530 of the passageway 500. The throat portion 530 is sufficiently smaller in cross section than the first portion 510 and the second portion 520, so that a venturi effect can be generated in the throat portion 530 to draw the liquid additive from the storage container 210 into the passageway 500.

For example, the first portion 510 or the second portion 520 of the passageway 500 can be substantially tapered to have cross sections decreasing gradually toward the throat portion 530. Alternatively, the first portion 510 or the second portion 520 of the passageway 500 can have a consistent cross section, as long as the cross section of the throat portion 530 is sufficiently smaller than the cross sections of the first portion and the second portion, to allow creation of a venturi effect in the throat portion. In addition, the first portion 510 and the second portion 520 can have any suitable geometrically regular or irregular cross sections.

As understood by a person of ordinary skill in the art, the shape or profile of the venturi plate 400 can vary as long as a fluid passageway as described above can be provided by the combination of the venturi plate 400, the bottom wall 118 and the sidewall 120 of the wash tub 116.

In the shown embodiment, the venturi plate 400 includes a first curved portion 410 and a second curved portion 420, connected to each other. For example, the first curved portion 410 and the second curved portion 420 can be symmetrical to each other, which makes it easy to manufacture. As shown, the first curved portion 410 decreases geometrically toward the second curved portion 420, and vice versa.

The venturi plate 400 is dimensioned so that it can be placed within the space S between the wash tub 116 and the wash basket 122, without interfering the rotation of the wash basket 122 and any other operation of the washing machine 100. The venturi plate 400 is fixedly attached to the bottom wall 118 and sidewall 120 of the wash tub 116, through any known means. For example, a first pair of tabs 430, extending oppositely from the first curved portion 410, can be provided to the first curved portion 410. The tabs 430 can be fixed to the bottom wall 118 and the sidewall 120, respectively, through nails or screws, for example. A second pair of tabs 440, extending oppositely from the second curved portion 420, can be provided to the second curved portion 420. The tabs 440 can be fixed to the bottom wall 118 and the sidewall 120, respectively, through nails or screws, for example.

In the shown embodiment, when the wash basket 122 rotates about the axle 168 within the wash tub 116 at a predetermined speed, a flow of fluid is established through the passageway 500 having a sufficiently small throat portion 530, which creates a venturi effect near the throat portion 530 of the passageway 500. The venturi effect results in a reduction of pressure in the throat portion 530. Depending on the rotating speed of the wash basket 122, a significant reduction of pressure or even a vacuum can be created in the throat portion 530, which results in a suction effect drawing the liquid additive from the liquid additive storage container 210 to the outlet 224 of the tube 220. Rotating direction of the wash basket 122 determines the exit direction of the liquid additive from the passageway 500. The rotating speed of the wash basket 122 can be controlled automatically or by a user through the control panel 108 of the washing machine 100.

Figure 9:
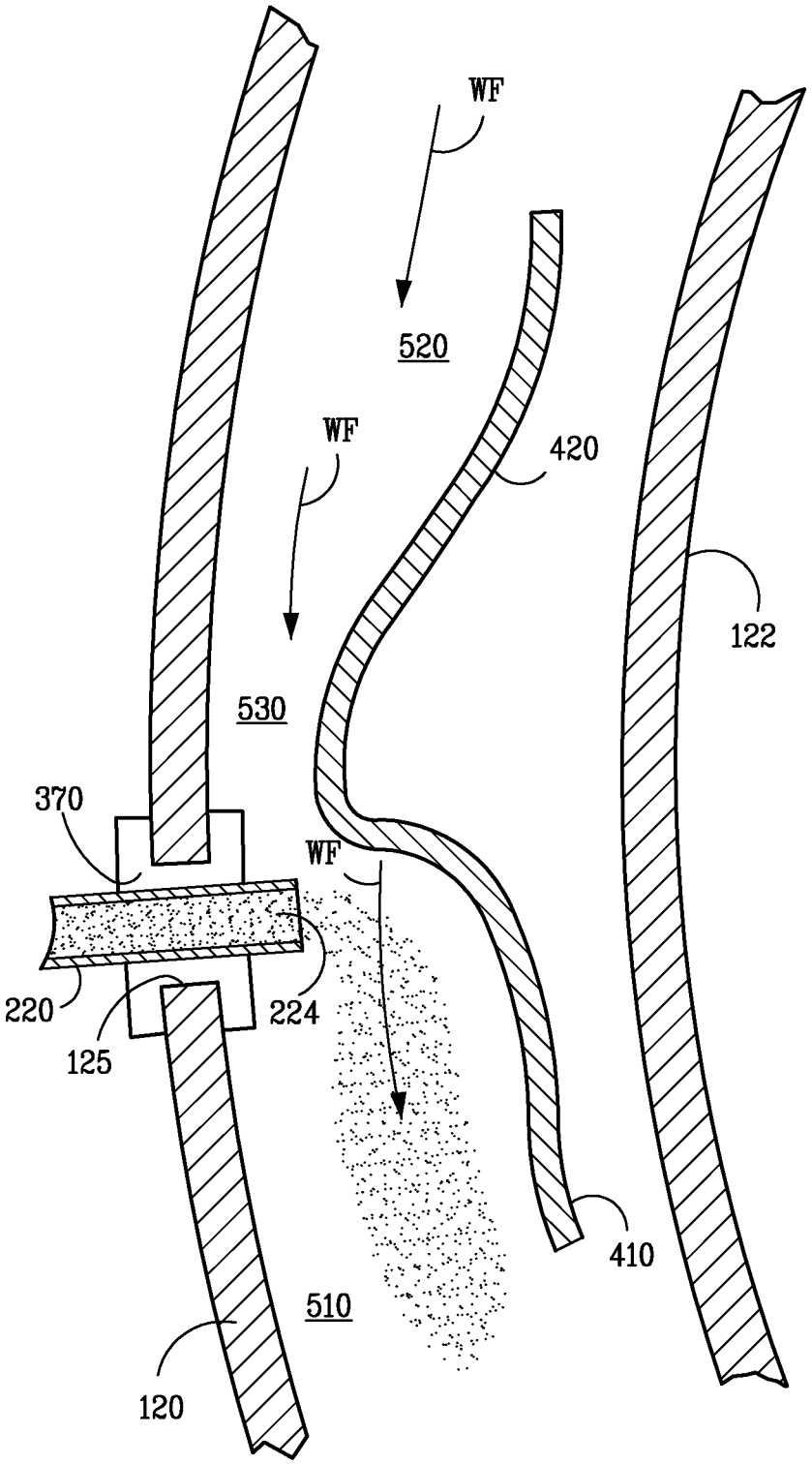
FIG. 9 is a schematic sectional view of the venturi member disposed in the washing machine, along Lines 9-9 shown in FIG. 8.

FIG. 9 is a schematic sectional view of the venturi plate 400 along Lines 9-9 in FIG. 8, after the venturi plate 400 is mounted to the washing machine 100. In the shown embodiment, the wash basket 112 rotates counter clockwise to generate a water flow WF passing through sequentially the second portion 520, the throat portion 530 and the first portion 510 of the passageway 500, as shown by the arrows in FIG. 9. The tube 220 is inserted into the wash tub 116 through an opening 125 formed in the sidewall 120 of the wash tub 116, to expose the outlet 224 to the passageway 500. A sealing member 370 is provided to ensure that no fluid leaking occurs between the tube 220 and the wash basket 116.

In the shown embodiment, the outlet 224 of the tube 220 is exposed at a position adjacent to and downstream of the throat portion 530 of the passageway 500 along the direction of the water flow WF. Thus, when the water flow WF flows through the passageway 500 to create a venturi effect, the liquid additive is drawn from the storage container 210 to form a liquid additive flow AF, as shown by the dotted lines in FIG. 9.

Figure 10:
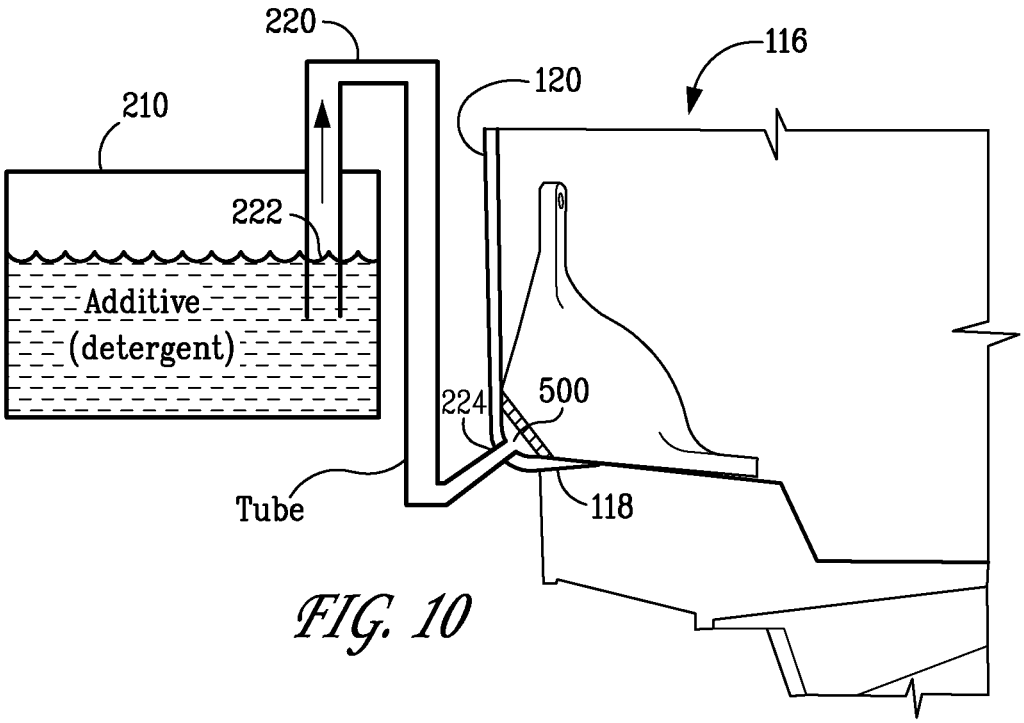
FIG. 10 is a schematic view illustrating a positional relationship of the wash tub and the storage container of the liquid additive dispensing apparatus.
Figure 11:
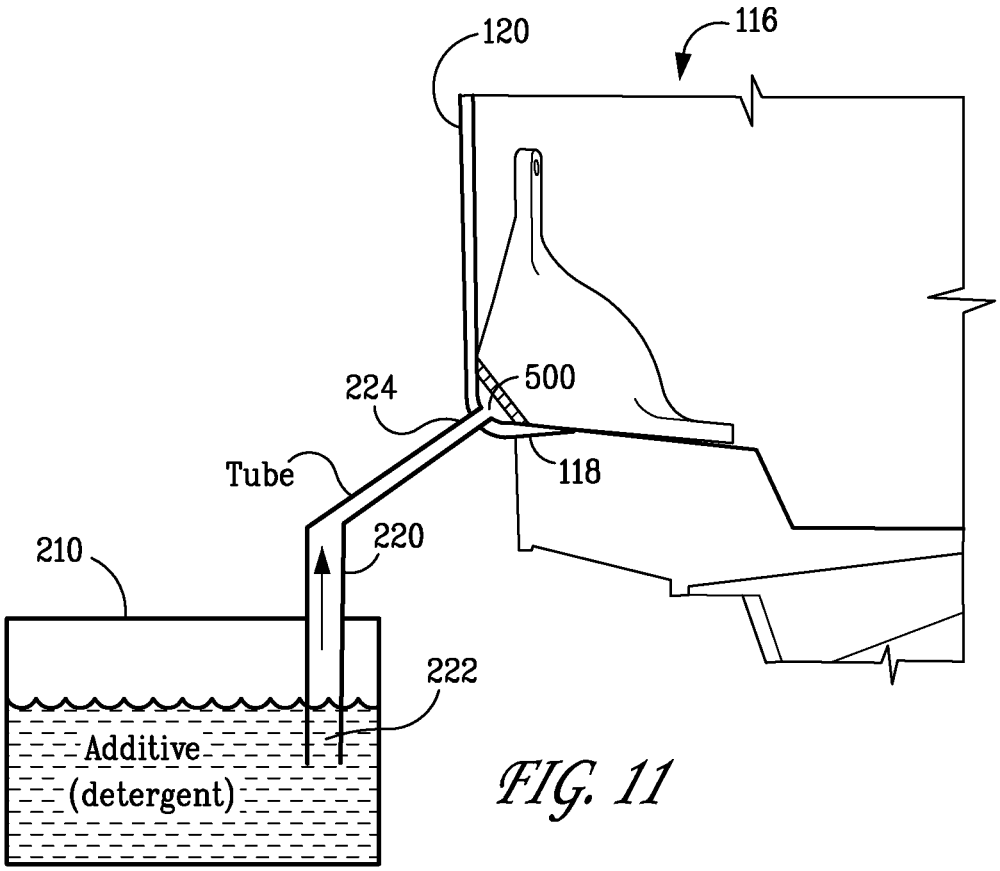
FIG. 11 is a schematic view illustrating an alternative positional relationship of the wash tub and the storage container of the liquid additive dispensing apparatus.

FIG. 10 illustrates a possible positional relationship between the wash tub 116 and the storage container 210, in which the storage container 210 is placed in a position attitudinally higher than the lower corner of the wash tub 116 where the venturi plate 400 is mounted. FIG. 11 illustrates another possible positional relationship between the wash tub 116 and the storage container 210, in which the storage container 210 is disposed in a position altitudinally lower than the corner of the wash tub 116. Due to the controllable suction effect generated by the venturi plate 400, the liquid additive can be drawn up into the passageway 500, notwithstanding the relative position of the storage container 210 with respect to the wash tub 116.

According to the above exemplary embodiments of the present invention, water is not used for dispensing the liquid additive to the wash tub, and it is not necessary to place the liquid additive storage container at a position altitudinally higher than the outlet of the liquid additive supply tube. Accordingly, the liquid additive dispensing apparatus according to the exemplary embodiments of the present invention is environmentally friendly. Furthermore, the limited space in the washing machine can be used more efficiently since the liquid additive storage container can be disposed at any position.

While the fundamental novel features of the invention as applied to various specific embodiments thereof have been shown, described and pointed out, it will also be understood that various omissions, substitutions and changes in the form and details of the devices illustrated and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A liquid additive dispensing apparatus for a washing machine comprising a tub for accommodating a fluid and a wash basket rotatably disposed within the tub, rotation of the wash basket rotating the fluid in the tub, the liquid additive dispensing apparatus comprising:

at least one storage container for storing a liquid additive;

a tube having an inlet coupled to the at least one storage container and an outlet coupled to the tub, for providing a fluid communication between the at least one storage container and the tub; and a venturi member comprising a first portion, an opposite second portion and a throat portion having a cross-section smaller than respective cross-sections of the first portion and the second portion, the throat portion connecting the first portion and the second portion and being in fluid communication with the outlet of the tube, wherein the venturi member is configured for disposition within the tub; and wherein the first portion, the second portion and the throat portion are shaped and dimensioned such that the venturi member, when disposed within the tub, is configured to create a venturi effect at the outlet of the tube upon rotation of the fluid so that a reduced pressure is created at the outlet to suck the liquid additive from the at least one storage container to the tub.

2. The liquid additive dispensing apparatus according to claim 1, wherein the venturi member comprises a venturi tube comprising the first portion, the second portion, and the throat portion.

3. The liquid additive dispensing apparatus according to claim 2, wherein the first portion comprises a first tapered portion, and the second portion comprises a second tapered portion.

4. The liquid additive dispensing apparatus according to claim 1, wherein the venturi member comprises a venturi plate configured for mounting to a bottom wall and a sidewall of the tub, such that when mounted the venturi plate, the bottom wall and the sidewall collectively define a passageway; and the passageway comprises the first portion, the opposite second portion and the throat portion connecting the first portion and the second portion.

5. The liquid additive dispensing apparatus according to claim 4, wherein the first portion of the passageway comprises a first tapered portion and the second portion of the passageway comprises a second tapered portion.

6. The liquid additive dispensing apparatus according to claim 4, wherein the venturi plate comprises a first curved portion and a second curved portion, connected to each other.

7. The liquid additive dispensing apparatus according to claim 1, wherein the at least one storage container comprises a body for containing the liquid additive and a cover for sealingly closing the body.

8. The liquid additive dispensing apparatus according to claim 7, wherein the body comprises a raised ridge dividing the body into a first chamber and a second chamber in fluid communication with each other, the first chamber having an opening in fluid communication with the inlet of the tube, the second chamber being configured to contain a predetermined amount of the liquid additive which is sucked into the first chamber once the reduced pressure created by the venturi member is below a predetermined value.

9. The liquid additive dispensing apparatus according to claim 7, wherein the at least one storage container comprises:

a diaphragm dividing the body into a first chamber having an opening in fluid communication with the inlet of the tube and a second chamber configured to contain a predetermined amount of the liquid additive; and a normally closed valve mounted to the diaphragm, which opens to allow the liquid additive to flow from the second chamber to the first chamber once the reduced pressure created by the venturi member is below a predetermined value.

10. The liquid additive dispensing apparatus according to claim 9, wherein the normally closed valve comprises a spring-biased valve.

11. A washing machine comprising:

a tub for accommodating a fluid;

a wash basket rotatably disposed within the tub, rotation of the wash basket rotating the fluid in the tub, the tub and the wash basket being apart to define a space therebetween; and a liquid additive dispensing apparatus configured to dispense a liquid additive into the space, the liquid additive dispensing apparatus comprising:

at least one storage container for storing the liquid additive;

a tube having an inlet coupled to the at least one storage container and an outlet coupled to the tub, for providing a fluid communication between the at least one storage container and the tub; and a venturi member disposed within the space and comprising a first portion, an opposite second portion and a throat portion having a cross-section smaller than respective cross-sections of the first portion and the second portion, the throat portion connecting the first portion and the second portion and being in fluid communication with the outlet of the tube, the first portion, the second portion and the throat portion being shaped and dimensioned such that the venturi member is configured to create a venturi effect at the outlet of the tube upon rotation of the fluid so that a reduced pressure is created at the outlet to suck the liquid additive from the at least one storage container to the tub.

12. The washing machine according to claim 11, wherein the venturi member comprises a venturi tube comprising the first portion, the second portion, and the throat portion.

13. The washing machine according to claim 12, wherein the first portion comprises a first tapered portion and the second portion comprises a second tapered portion.

14. The washing machine according to claim 11, wherein the venturi member comprises a venturi plate mounted to a bottom wall and a sidewall of the tub, the venturi plate, the bottom wall and the sidewall collectively defining a passageway; and the passageway comprises the first portion, the opposite second portion and the throat portion connecting the first portion and the second portion.

15. The washing machine according to claim 14, wherein the first portion comprises a first tapered portion and the second portion comprises a second tapered portion.

16. The washing machine according to claim 14, wherein the venturi plate comprises a first curved portion and a second curved portion, connected to each other.

17. The washing machine according to claim 11, wherein the at least one storage container comprises a body for containing the liquid additive and a cover for sealingly closing the body.

18. The washing machine according to claim 17, wherein the body comprises a raised ridge dividing the body into a first chamber and a second chamber in fluid communication with each other, the first chamber having an opening in fluid communication with the inlet of the tube, the second chamber being configured to contain a predetermined amount of the liquid additive which is sucked into the first chamber once the reduced pressure created by the venturi member is below a predetermined value.

19. The washing machine according to claim 17, wherein the at least one storage container comprises:

a diaphragm dividing the body into a first chamber having an opening in fluid communication with the inlet of the tube and a second chamber configure to contain a predetermined amount of the liquid additive; and a normally closed valve mounted to the diaphragm, which opens to allow the liquid additive to flow from the second chamber to the first chamber once the reduced pressure created by the venturi member is below a predetermined value.

20. The washing machine according to claim 19, wherein the normally closed valve comprises a spring-biased valve.

* * * * *